US009004985B2

(12) United States Patent
Jiang

(10) Patent No.: US 9,004,985 B2
(45) Date of Patent: Apr. 14, 2015

(54) FIXED ABRASIVE PAD AND METHOD FOR FORMING THE SAME

(75) Inventor: Li Jiang, Shanghai (CN)

(73) Assignee: Semiconductor Manufacturing International (Shanghai) Corporation, Shanghai (CN)

( * ) Notice: Subject to any disclaimer, the term of this patent is extended or adjusted under 35 U.S.C. 154(b) by 697 days.

(21) Appl. No.: 13/286,961

(22) Filed: Nov. 1, 2011

(65) Prior Publication Data

US 2012/0244792 A1 Sep. 27, 2012

(30) Foreign Application Priority Data

Mar. 22, 2011 (CN) ..... 2011 1 0068907

(51) Int. Cl.
*B24D 7/14* (2006.01)
*B24B 27/00* (2006.01)
*B24B 37/24* (2012.01)

(52) U.S. Cl.
CPC ..... *B24B 37/245* (2013.01)

(58) Field of Classification Search
USPC ..... 451/41, 540; 51/295
See application file for complete search history.

(56) References Cited

U.S. PATENT DOCUMENTS

| | | | | |
|---|---|---|---|---|
| 5,453,312 | A * | 9/1995 | Haas et al. | 428/143 |
| 6,155,910 | A * | 12/2000 | Lamphere et al. | 451/41 |
| 6,293,980 | B2 * | 9/2001 | Wei et al. | 51/298 |
| 6,371,842 | B1 * | 4/2002 | Romero | 451/540 |
| 6,517,425 | B2 | 2/2003 | Walker et al. | |
| 2002/0037683 | A1 * | 3/2002 | Goers et al. | 451/41 |
| 2002/0049027 | A1 * | 4/2002 | Walker et al. | 451/41 |
| 2003/0022598 | A1 * | 1/2003 | Muilenburg et al. | 451/28 |
| 2004/0235406 | A1 * | 11/2004 | Duescher | 451/527 |
| 2005/0118939 | A1 * | 6/2005 | Duescher | 451/527 |
| 2005/0227590 | A1 * | 10/2005 | Sung | 451/41 |
| 2010/0003904 | A1 * | 1/2010 | Duescher | 451/259 |
| 2010/0151201 | A1 * | 6/2010 | Erickson et al. | 428/148 |
| 2012/0144755 | A1 * | 6/2012 | Erickson et al. | 51/309 |

FOREIGN PATENT DOCUMENTS

| | | | |
|---|---|---|---|
| CN | 1252021 | A | 5/2000 |
| JP | 2004338028 | A | 12/2004 |
| JP | 201154635 | A | 3/2011 |

* cited by examiner

*Primary Examiner* — Joseph J Hail
*Assistant Examiner* — Marc Carlson
(74) *Attorney, Agent, or Firm* — Anova Law Group, PLLC

(57) ABSTRACT

A fixed abrasive pad includes a substrate and a plurality of discrete abrasive blocks attached thereon, wherein the abrasive blocks comprise a plurality of abrasive sub-layers, wherein the abrasive density of the sub-layers increases layer-by-layer from the top sub-layer to the bottom sub-layer according to a predetermined ratio. The predetermined ratio ranges from about 1.099 to about 1.124.

16 Claims, 4 Drawing Sheets

FIXED ABRASIVE PAD AND METHOD FOR FORMING THE SAME

CROSS REFERENCE TO RELATED APPLICATIONS

The present application claims the priority of Chinese Patent Application No. 201110068907.8, entitled "FIXED ABRASIVE PAD AND METHOD FOR FORMING THE SAME", and filed on Mar. 22, 2011, the entire disclosure of which is incorporated herein by reference.

FIELD OF THE INVENTION

The present invention relates to the semiconductor manufacturing field, and more particularly, to a fixed abrasive pad having multiple abrasive sub-layers with increasing abrasive density and a method for forming the same.

BACKGROUND OF THE INVENTION

In various semiconductor manufacturing processes, a planarized wafer surface is of prime importance for the miniaturization and high density of semiconductor devices. A conventional method for planarizing the wafer surface is a chemical mechanical polishing (CMP) method which adds polishing slurry between a wafer surface to be polished and a polishing pad, so as to planarize the wafer surface by using a combined effect of mechanical friction and chemical reactions between the polishing slurry and the wafer surface. The conventional CMP method is a dissociation abrasive polishing method, in which the abrasives included in the polishing slurry are randomly distributed on the polishing pad. The abrasives have a non-uniform distribution density, which may result in adverse polishing effects, a low utilization ratio, environmental pollutions caused by the dumped slurry, and the like. Therefore, the free abrasive polishing method has been gradually replaced by a fixed abrasive polishing method.

In the fixed abrasive polishing method, the abrasives and the polishing pad are combined together to form a fixed abrasive pad with a uniformly concave-convex patterned surface. Referring to FIG. 1, a conventional fixed abrasive polishing method includes conveying a polishing pad 102 to a polishing platen 101 by an input roller 105*a* and an output roller 105*b*, supplying a surface of the polishing pad 102 with a polishing slurry solution, mounting a wafer 103 to a polishing head 104, which forces the wafer surface downwardly to make contact with an abrasive layer of the polishing pad 102, and starting a driving power to rotate the polishing platen 101 through a bearing 100 and the wafer 103 through the polishing head 104. The polishing platen 101 moves relative to the wafer 103, and rubs the surface of the wafer 103 against the abrasive layer on the surface of the polishing pad 102, so that the surface of the wafer 103 is polished. In this polishing process, only the projections (referred as abrasive blocks herein) attached on the polishing pad 102 have contact with the surface of the wafer 103, so that a contact surface area between the polishing slurry and the wafer is smaller than a contact surface area in the conventional free abrasive polishing method. The smaller contact surface area may result in a greater pressure therein. Accordingly, the above-described CMP process may require a faster polishing speed to obtain a desired polishing effect. The over polish window may be enlarged, which may greatly reduce the erosions and dishing problems, so that the product yield can be improved. Moreover, because the polishing speed has a high selectivity to the surface topography of the wafer, a desired polishing effect may be achieved by removing fewer wafer materials, thus reduces the production cost. Moreover, the polishing speed may vary according to different chemical agents added into the polishing process. With the continuous development of semiconductor manufacturing technology, the critical dimensions of semiconductor devices are getting smaller continuously, so the fixed abrasive polishing method becomes more and more important.

However, when applying the fixed abrasive polishing method, the abrasive blocks fixed on the polishing pad are continuously consumed until scrapped, as the polishing process goes on. The quality of the abrasive blocks may affect the polishing quality greatly. The consumption or damage of the abrasive blocks can cause a decrease in removal rates and an increase in scratches, which renders the polishing process unstable. Therefore, obtaining a stable polishing performance has been a significant problem for the fixed abrasive polishing method.

US Patent Publication No. 20020049027 to Walker et al. discloses methods and apparatus using a fixed abrasive polishing pad to perform mechanical polishing of a article surface. However, this patent only partially solves the above described problems.

BRIEF SUMMARY OF THE INVENTION

It is therefore an object of the present invention to provide a fixed abrasive pad that can solve the problems related to the decrease in removal rates and increase in scratches. The fixed abrasive polishing pad includes a substrate and a plurality of discrete abrasive blocks attached thereon, wherein each of the abrasive blocks includes a plurality of abrasive sub-layers, wherein the abrasive density of the abrasive sub-layers increases layer-by-layer from a top abrasive sub-layer to a bottom abrasive sub-layer.

Optionally, the abrasive sub-layers have substantially a same thickness.

Optionally, the abrasive density of the abrasive sub-layers increases layer by layer from the top sub-layer to the bottom sub-layer according to a predetermined ratio.

Optionally, the predetermined ratio is a ratio of a surface area of the abrasive block before an abrasive sub-layer is polished to a surface area of the abrasive block after the abrasive sub-layer is polished.

Optionally, the predetermined ratio ranges from about 1.099 to about 1.124.

Optionally, a number of the sub-abrasive layers ranges from 3 to 10.

Optionally, the abrasive blocks are distributed uniformly on the substrate and have an hexagonal shape.

Another embodiment of the present invention provides a method for forming a fixed abrasive pad. The method includes providing a substrate, successively depositing a plurality of abrasive sub-layers on the substrate, and patterning the sub-layers to form a plurality of discrete abrasive blocks. In an embodiment, each deposited abrasive sub-layer is followed by a solidifying step, wherein an abrasive density of the abrasive sub-layers increases layer-by-layer from a top sub-layer to a bottom sub-layer; and patterning the abrasive sub-layers with a mould to form a plurality of discrete abrasive blocks, wherein the mould has a gravure pattern corresponding with the abrasive blocks.

Optionally, all the sub-abrasive layers have substantially a same thickness.

Optionally, the abrasive density of the abrasive sub-layers increases layer-by-layer from the top sub-layer to the bottom sub-layer according to a predetermined ratio.

Optionally, the predetermined ratio is a ratio of a surface area of the abrasive block before an abrasive sub-layer is polished to a surface area of the abrasive block after the sub-abrasive layer is polished.

Optionally, the predetermined ratio ranges from about 1.099 to about 1.124.

Optionally, the abrasive block includes a number of the abrasive sub-layers ranging from 3 to 10.

Optionally, the solidifying is performed by covering the deposited sub-layer with a cover and cooling the cover injecting deionized water at a temperature from about 30° C. to 50° C.

Embodiments of the present invention have the following advantages over the conventional techniques.

The fixed abrasive pad is manufactured with a plurality of abrasive sub-layers having a same or similar thicknesses formed on a substrate. The abrasive density of the abrasive sub-layers increases layer-by-layer from the top sub-layer to the bottom sub-layer according to a predetermined ratio. The sub-layers are patterned to form a plurality of discrete abrasive blocks. Therefore, the decreasing level of the area of the abrasive block may correspond with the increasing level of the abrasive density, which ensures a stable polishing process.

DETAILED DESCRIPTION OF THE INVENTION

In the following detailed description, reference is made to the accompanying drawings which form a part hereof, and in which is shown by way of illustration specific embodiments in which the invention may be implemented. The term "upper", "lower", "vertical", "horizontal", "surface", "height", "width", "top", "bottom", etc., is used with reference to the orientation of the Figures being described. Because components of embodiments of the present invention can be positioned in a number of different orientations, the term is used for purposes of illustration and is not limiting.

The features, characteristics and advantages of the present invention will be described in detail in conjunction with the accompanying drawings.

Although embodiments of the present invention are described with reference to preferred embodiments, those skilled in the art may modify and vary the embodiments without departing from the spirit and scope of the present invention. Therefore, the present invention should not be limited by the embodiments disclosed herein.

Conventionally, for forming an abrasive layer on the fixed abrasive pad, particles such as $CeO_2$, $SiO_2$, and the like, are mixed with resin adhesive (or other organic polymers) and the mixture thereof are pressed into an array of uniformly distributed abrasive blocks. During the polishing process, the wafer and the abrasive layer are pressed and rubbed against each other, so the abrasive block array is subjected to shear forces in different directions. The resin adhesive is dissolved by the polishing slurry, so that the particles (which are the abrasives, such as $CeO_2$) are released gradually. As the polishing process goes on, the abrasive blocks fixed on the polishing pad is consumed gradually.

Figure 1:
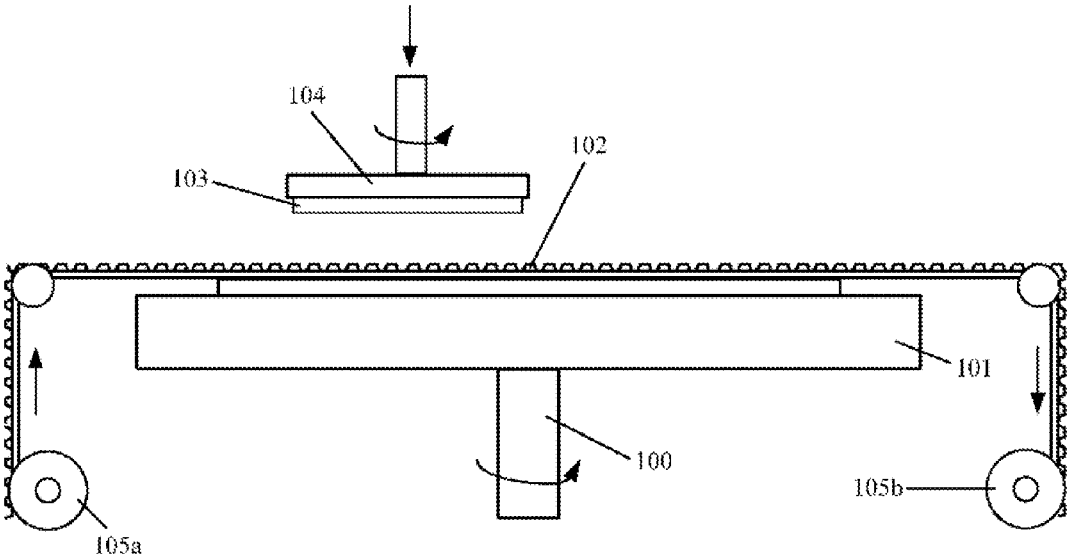
Fig. 1 (Prior Art)
FIG. 1 is a schematic cross-sectional view of a polishing device applied in a fixed abrasive polishing method, as known in the prior art.
Figure 2:
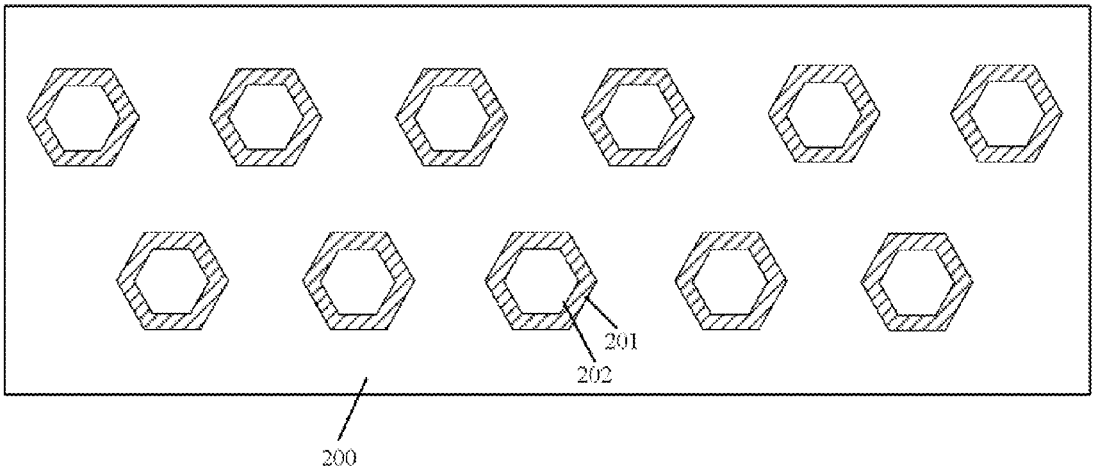
FIG. 2 is schematic top view illustrating a consumption of abrasive blocks attached on a fixed abrasive pad.
Figure 3:
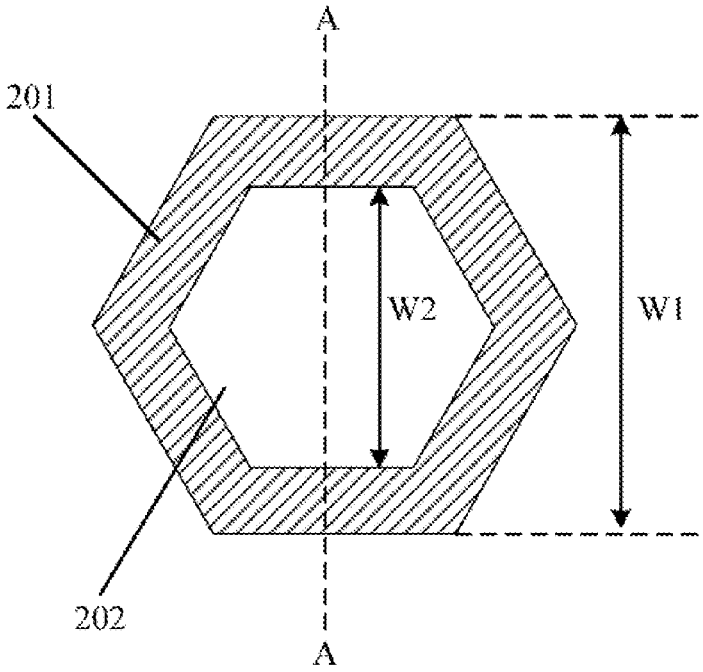
FIG. 3 is a schematic enlarged view of one of the abrasive blocks shown in FIG. 2.

FIG. 2 is a schematic top view illustrating the consumption of the abrasive blocks fixed on the fixed abrasive pad that will be used in embodiments of the present invention. As shown in FIG. 2, a fixed abrasive pad 200 includes a substrate having a plurality of regular hexagonal abrasive blocks formed on the substrate. The abrasive block array constituted by these abrasive blocks is the abrasive layer of the fixed abrasive pad 200. A regular hexagon 201 shown in FIG. 2 is one of the abrasive blocks before the polishing process. As the polishing process goes on, the abrasive blocks are getting smaller, which is shown as a regular hexagon 202 in FIG. 2. The shaded area in FIG. 2 shows the polished part of the abrasive blocks. Specifically, the polished abrasive blocks are decreased in height and width. FIG. 3 is a schematic enlarged view of one of the abrasive blocks shown in FIG. 2. Referring to FIG. 3, W1 is a width of the regular hexagon 201 before the polishing process, wherein a distance between two opposite sides of the regular hexagon is defined as the width of the regular hexagon. W2 is a width of the regular hexagon 202 after the polishing process goes on for a period of time. The decrease in width is provided by the difference W1−W2.

Figure 4:
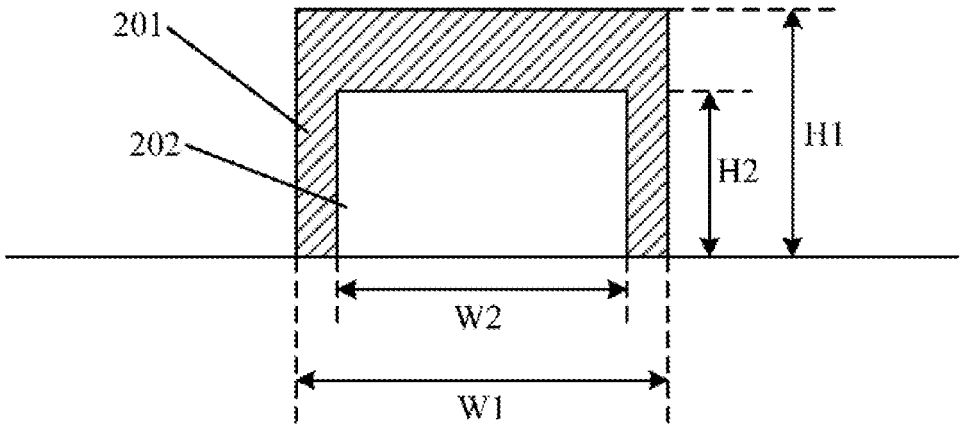
FIG. 4 is a schematic cross-sectional view of the abrasive block shown in FIG. 3 along the line A-A.

FIG. 4 is a schematic cross-sectional view of the abrasive block shown in FIG. 3 along the line A-A. FIG. 4 not only shows the decrease in the width of the abrasive block, but also the decrease in the height thereof. H1 is a height of the regular hexagon 201 before the polishing process, and H2 is a height of the regular hexagonal 202 after the polishing process goes on for a period of time, so the decrease of the height of the abrasive block is H1−H2. The shaded area presents the polished width and height of the abrasive block 201.

In the fixed abrasive polishing process, the polishing effect of the wafer surface mainly depends on the quality of the polishing pad surface. A damaged abrasive sub-layer or a consumed abrasive block may decrease the removal rates, increase scratches in the wafer to be polished, and cause an instability in the polishing process. For solving these problems, an embodiment of the present invention provides a fixed abrasive pad that includes a substrate and a plurality of discrete abrasive blocks attached thereon. In an embodiment, each of the abrasive blocks may include multiple abrasive sub-layers, and the abrasive density of the abrasive sub-layers increases layer-by-layer from the top sub-layer to the bottom sub-layer, wherein the top sub-layer is disposed the farthest away from the substrate and the bottom sub-layer is disposed closest to the substrate. In an embodiment, each of the abrasive blocks has a number of the abrasive sub-layers ranging from 3 to 10. The number of abrasive sub-layers determines the height of the abrasive blocks on the fixed abrasive pad. In an embodiment, the abrasive sub-layers have a thickness that is substantially the same. Considering factors such as errors or tolerance in the manufacturing processes, the thickness of the abrasive sub-layers may be very similar to each other. In an embodiment, the abrasive density of the abrasive sub-layers increases layer-by-layer from the top sub-layer toward the bottom sub-layer according to a predetermined ratio, which is defined as the ratio of an abrasive block surface area before a sub-abrasive layer (which is not the bottom sub-abrasive layer) is polished to an abrasive block surface area after this sub-abrasive layer is polished. As the polishing process progresses, the abrasive blocks are consumed to some extent, and their dimensions (such as width, height, and the like) decrease due to the rubbing action against a wafer to be polished. Inventors of the present invention have found that if the abrasive density of the abrasive sub-layers are configured to correspond to the changing surface areas of the abrasive block that are in contact with the polished wafer, the polishing process may be stable. Specifically, as the polishing process goes on, when an upper abrasive sub-layer is polished, the surface area of the abrasive block also decreases, and the decreasing level of the surface area of the abrasive block is related to the increasing level of the density of the abrasive. In an embodiment, a ratio of the surface area of the abrasive block before an abrasive sub-layer (which is not the bottom abrasive sub-layer) is polished to the surface area of the abrasive block thereafter substantially equals to a ratio of the abrasive density of an abrasive sub-layer beneath the polished abrasive sub-layer to the density of the polished abrasive sub-layer. Abrasive blocks having multiple abrasive sub-layers formed following this ratio provide a stable polishing process. In an embodiment, the increasing level of the abrasive density may also be configured to be proportional to the decreasing level of the width or height of the abrasive block. Embodiment of the present invention will be illustrated in detail in conjunction with the accompanying drawings hereinafter.

Figure 7:
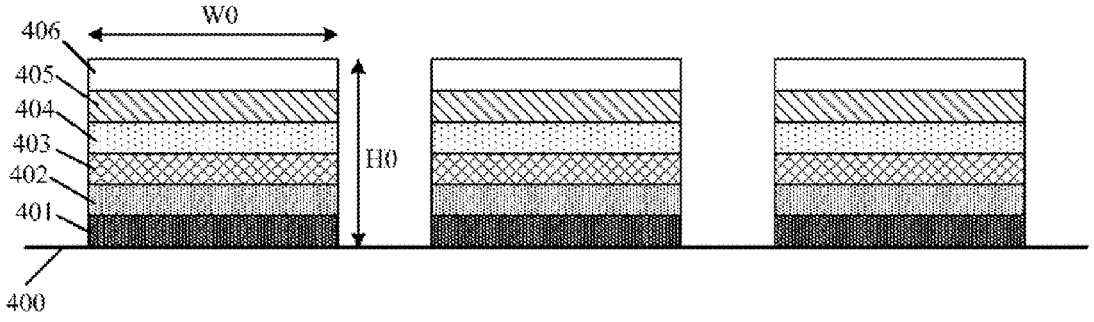
FIG. 7 is a schematic cross-sectional view illustrating a fixed abrasive pad having a plurality of abrasive blocks according to an embodiment of the present invention.

FIG. 7 is a schematic cross-sectional view of an fixed abrasive pad according to the embodiment of the present invention. Referring to FIG. 7, the fixed abrasive pad includes a substrate 400 and a plurality of discrete abrasive blocks attached thereon. In an exemplary embodiment, each of the abrasive blocks includes six sub-abrasive layers having a same thickness, and the abrasive density of each of the abrasive sub-layers increases from a top abrasive sub-layer 406 to a bottom abrasive sub-layer 401 layer-by-layer according to a predetermined ratio. In an embodiment, the predetermined ratio ranges from about 1.099 to about 1.124. The abrasive may include at least one of cerium dioxide, silica, Adamas diamond compounds, silicon carbide, boron carbide, zirconium oxide, aluminum oxide and silicon nitride. The abrasive blocks can be a regular hexagonal shape, and a width of the abrasive block is defined as a distance between the opposite sides of the regular hexagon. In another embodiment, the abrasive blocks may have a variety of geometric shapes, including without limitation, circular shape (the width equals to the diameter), square shape (the width equals to the length of a side), regular triangle (the width equals to the length of a line between midpoints of two sides), and the like. In yet another embodiment, the abrasive block also may have irregular shapes or a combination of variety of regular shapes, and the abrasive density of every abrasive sub-layer is configured according to the change of the surface area of the abrasive block after one sub-abrasive layer is polished. The change may be obtained by conducting adequate experiments.

In an embodiment, the abrasive blocks have regular shapes and are distributed uniformly on the substrate. The decrease of the surface area of the abrasive block is directly related to its width decrease. Therefore, in an embodiment, the change of the surface area of the abrasive block is measured by the change of the width thereof. The change of the area is configured to be proportional to the change of the abrasive density in the sub-abrasive layers. Therefore, a stable polishing performance may be achieved using this abrasive polishing pad, and the accuracy and quality of the polishing may be improved.

In an embodiment, the abrasive block on a fixed abrasive pad which has not been polished has a hexagon-shaped structure with a height H0 of 30 μm and a width W0 of 108 μm. In an exemplary embodiment, the abrasive block includes six abrasive sub-layers, and the thickness of each abrasive sub-layer is about 5 μm. Before the fixed abrasive pad is polished, the abrasive block has a surface area S0 according to the following equation:

$$S0=6*(½)*(108/3)*(108/2)\approx 10101.32\ \mu m^2 \quad (1)$$

Figure 8:
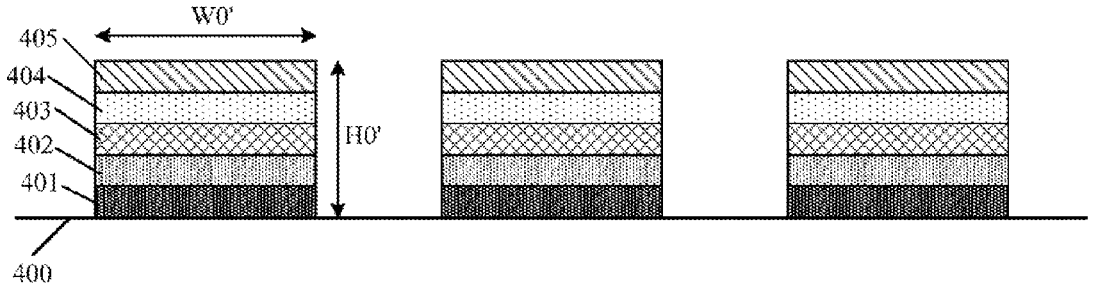
FIG. 8 is a schematic cross-sectional view of the fixed abrasive pad shown in FIG. 7 after a top abrasive sub-layer is polished.

FIG. 8 is a schematic cross-sectional view illustrating the fixed abrasive pad shown in FIG. 7 after a top abrasive sub-layer 406 is polished. As shown in FIG. 8, as the polishing process goes on, when the top sub-abrasive layer 406 is polished, four sidewalls of a square-shaped abrasive block are also polished to some extent. Inventors of the present invention have discovered that the decreasing level of a sidewall in a square-shaped abrasive block is generally half of the decreasing level of the height. When the abrasive block is a hexagon-shaped structure, the decreasing level of the width equals to the decreasing level of the height. Therefore, when the height decreases by 5 μm, the width also decreases by 5 μm. In other words, after the top layer is polished, the abrasive block has a height H0' of 25 μm, a width W0' of 103 μm, and accordingly an area S1=6*(½)*(103/3)*(103/2≈9187.66 $\mu m^2$. Therefore, when a ratio of the abrasive density in a second sub-abrasive layer 405 to the abrasive density in the top sub-abrasive layer 406 is configured to be S0/S1, which approximately equals to 1.099, the polishing process is stable. Likewise, when a ratio of the abrasive density in the bottom abrasive sub-layer 401 (which is the sixth layer) to the abrasive density in a fifth sub-layer 402 is configured to be 1.124, the polishing process is stable.

It can be concluded from the foregoing analysis that, theoretically, the predetermined ratio is not a constant value. However, when the decreasing level of the area of the abrasive block after an abrasive sub-layer (which is not the bottom abrasive sub-layer) that is polished is very close to the decreasing level of the area of the abrasive block after an abrasive sub-layer next to the abrasive sub-layer is polished, the predetermined ratio can be considered as a constant value. For example, in an embodiment, let's assume the abrasive density in the top abrasive sub-layer 406 (which is the first sub-layer) is x, then:

- the density of the abrasive in the second abrasive sub-layer 405 is $x*y$;
- the density of the abrasive in the third abrasive sub-layer 404 is $x*y^2$;
- the density of the abrasive in the fourth abrasive sub-layer 403 is $x*y^3$;
- the density of the abrasive in the fifth abrasive sub-layer 402 is $x*y^4$; and
- the density of the abrasive in the sixth abrasive sub-layer 401 is $x*y^5$,
- wherein the predetermined ratio y ranges from about 1.099 to about 1.124.

Forming abrasive sub-layers which include abrasives of different densities may be achieved by forming a plurality of mixtures including abrasive particles and organic polymers of different densities, which is disclosed in descriptions of a method for forming a fixed abrasive pad hereinafter.

As the polishing process continues, the abrasive blocks attached on the fixed abrasive pad are consumed to some extent, and the dimensions of the abrasive blocks such as height, width, area, and the like, may decrease at different levels. Inventors of the present invention discovered that the height decrease did not impact the polishing rates. However, when the height was decreased to be lower than a critical value, the abrasive blocks may not be further utilized in the polishing process because the consumed abrasive blocks caused scratches on the wafer surface. That is, the polishing pad had been scrapped and replaced with a new fixed abrasive pad to continue the polishing process. The width decrease resulted in a decrease in the polishing efficiency and in the removal rate of the polishing process. Inventors of the present invention also discovered that when the width of the abrasive blocks was decreased to a value smaller than a critical value, the abrasive blocks could not be further utilized in the polishing process. That is, the polishing pad had to be scrapped and replaced with a new fixed abrasive pad to perform subsequent polishing processes. However, inventors of the present inventors also discovered that, when the lower abrasive sub-layers have relatively higher abrasive densities, a stable polishing process could be obtained, and the utilization ratio and the working life of the fixed abrasive pad were greatly improved.

The present invention also provides a method for forming a fixed abrasive pad that has the above described features and characteristics. The method includes the following steps:

step 101: providing a substrate;

step 102: successively depositing a plurality of abrasive sub-layers on the substrate; and step 103: patterning the sub-abrasive layers to form a plurality of discrete abrasive blocks, wherein the patterning is performed using a mould having a gravure pattern corresponding to the discrete abrasive blocks. In an embodiment, the method further includes a solidifying step after the deposition of each abrasive sub-layer.

Hereafter, the foregoing method for forming the fixed abrasive pad is described in detail in conjunction with the accompanying drawings.

Figure 5:
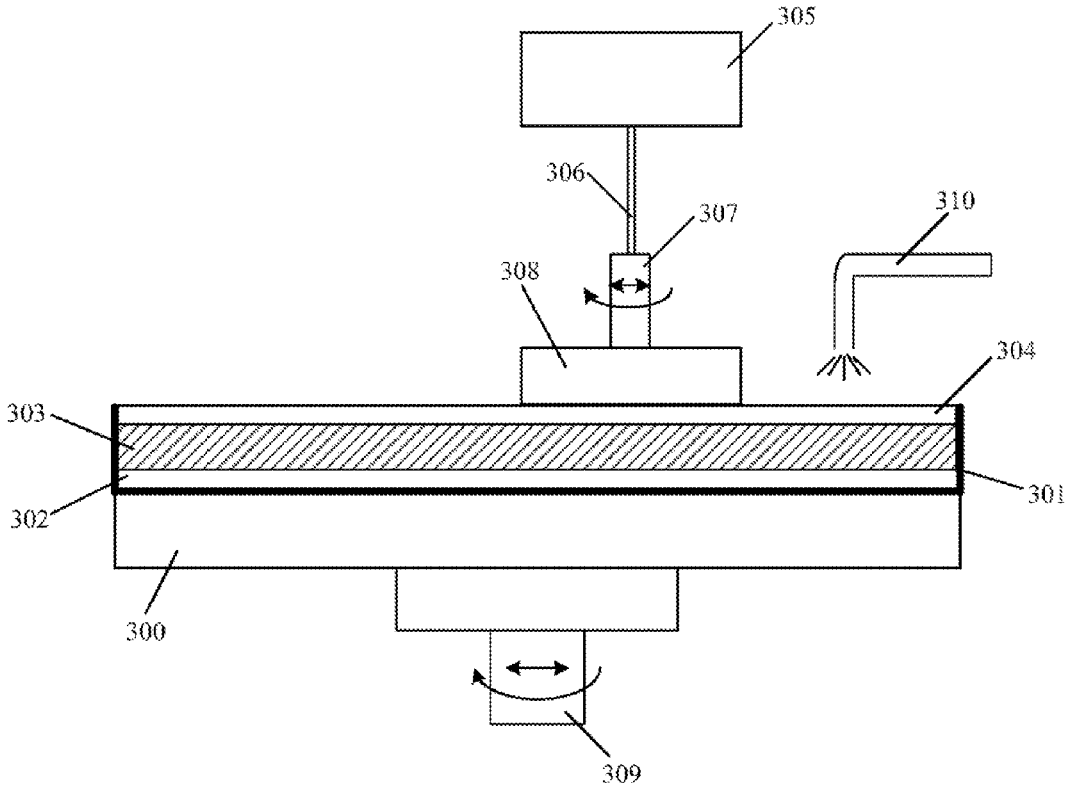
FIG. 5 is a schematic cross-sectional view illustrating a system for forming a fixed abrasive pad according to an embodiment of the present invention.

FIG. 5 is a schematic cross-sectional view illustrating a system for forming the fixed abrasive pad according to the embodiment of the present invention. As shown in FIG. 5, a system for manufacturing the fixed abrasive pad may include a tool platen 300, a container 301 disposed on the tool platen 300, an injecting unit (which includes one or more injecting troughs 305, an injecting pipe 306, a driving assembly 307 and an injecting head 308), and a cooling and solidifying device 310.

In an embodiment, a plurality of mixtures including abrasive particles and organic polymers may be prepared separately. The density (in weight percentage) of the abrasive particles in the mixtures may be increased according to a predetermined ratio. In an example embodiment, the abrasive density of the first mixture is "a" and the predetermined ratio is "b". It should be noted that the predetermined ratio is not a constant value but can be treated as a constant value greater than unity in practical applications, i.e., "b" is greater than 1. Then the abrasive density of the second mixture is a*b, the density of the third mixture is $a*b^2$, the density of the fourth mixture is $a*b^3$, and so forth. In an embodiment, a number of the mixtures to be made depends on the number of the abrasive sub-layers to be formed in the fixed abrasive pad. In an exemplary embodiment, the number of the abrasive sub-layers to be formed in the fixed abrasive pad is six, six types of mixtures will be made accordingly. In an embodiment, the abrasives may include at least one of cerium dioxide, silica, Adamas diamond compounds, silicon carbide, boron carbide, zirconium oxide, aluminum oxide and silicon nitride.

For improving the mixing effect of the abrasive particles and the organic polymers, a surface modification process may be performed to the abrasive particles according to an embodiment of the present invention. Because the abrasive particles may include inorganic materials, a majority of which has hydrophilic surfaces and is incompatible with the organic polymers, the abrasive particles may not be uniformly distributed in the organic polymers, and the abrasive particles and the organic polymers may not be combined tightly. In some embodiments, a mechanical chemical modification method can be used for the surface modification performed to the abrasive particles, such as a high energy ball milling method, a stirring milling method, a high speed shearing method, a high frequency ultrasound method. New surfaces of the abrasive particles are exposed after the modification process. Thanks to a large quantity of dangling bonds on the new surfaces and the high local temperatures during the modification process, the abrasive particles may chemically react with the surface modification agents, and the surface features of the abrasive particles are thus modified.

In an embodiment, the mixtures are separately put into the injecting troughs 305 (only one of the injecting troughs is shown in FIG. 5). In the manufacturing process, the mixtures are injected into the container 301 one after another through the injecting pipe 306, the driving assembly 307 with an injecting hole included therein and the injecting head 308. In an embodiment, a substrate 302 of the fixed abrasive pad is provided in the container 301 (step 101). In an embodiment, the substrate 302 may be a rigid substrate, such as a PMMA board, PVC board, PC board or PET board. In another embodiment, the substrate 302 may be a flexible substrate, such as polyurethane, polyolefin, styrene, polyester, polyesteramine or black damp cloth. In yet another embodiment, the substrate 302 may be a multi-layer substrate forming by combining a rigid substrate with a flexible substrate. Thereafter, the mixture with the highest abrasive density is injected into the container 301 and deposited on the substrate 302. The system then covers the mixture using a covering plate 304. The tool platen 300 is driven to rotate and move horizontally by a driving shaft 309. And the covering plate 304 is pressed down by the injecting head 308 which is driven to rotate and move horizontally by the driving assembly 307. The mixture injected into the container 301 may be distributed uniformly on the substrate 302 and the abrasive particles in the mixture also may be distributed uniformly. A thickness of a sub-abrasive layer 303 formed subsequently also may be controlled by adjusting a pressure applied to the covering plate 304 by the injecting head 308.

Thereafter, the mixture is cooled by the cooling and solidifying device 310, which forms the abrasive sub-layer 303 that is the bottom sub-layer attached to the substrate 302 of the fixed abrasive pad. In a specific embodiment, deionized water (a temperature of which is generally ranged form about 30 degree centigrade to about 50 degree centigrade) is injected to the surface of the covering plate 304 by the cooling and solidifying device 310, which cools and solidifies the molten mixture including abrasive particles and organic polymers, and forms the sub-abrasive layer 303 on the substrate 302.

After removing the cover plate 304, other abrasive sub-layers having substantially the same thickness with the abrasive sub-layer 303 are formed thereon layer-by-layer in the same way, in which the applied mixtures have an abrasive density that is decreasing layer-by-layer as the abrasive sub-layers are formed. Or, the abrasive density of the abrasive sub-layers increase layer-by-layer form top to bottom according to the predetermined ratio. The step 102 is completed.

Figure 6:
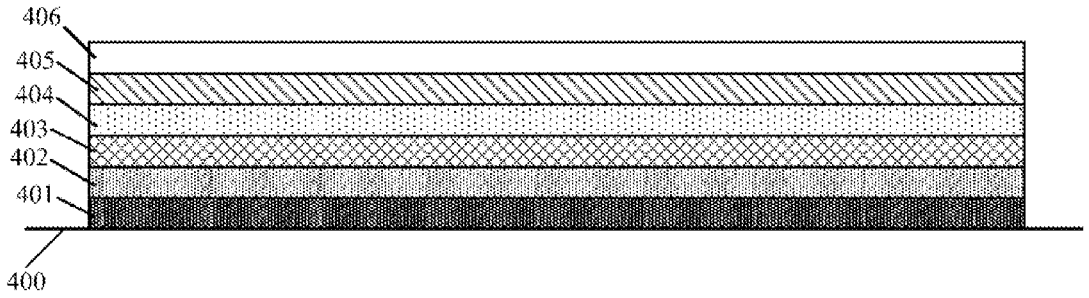
FIG. 6 is a schematic cross-sectional view illustrating a plurality of abrasive sub-layers formed on a substrate.

Thereafter, the system continues with step 103, where the abrasive sub-layers are pressed by a mould to form a plurality of discrete abrasive blocks. The mould has a gravure pattern corresponding to the geometric shape of the abrasive blocks. FIG. 6 is a schematic cross-sectional view of a plurality of sub-abrasive layers formed on the substrate. In an exemplary embodiment, six sub-abrasive layers formed layer-by-layer on a substrate 400 are shown. The six layers include an abrasive sub-layer 401, an abrasive sub-layer 402, an abrasive sub-layer 403, an abrasive sub-layer 404, an abrasive sub-layer 405, and an abrasive sub-layer 406. These abrasive sub-layers constitute the abrasive sub-layers of the fixed abrasive pad. In an embodiment, the abrasive layer is pressed with the mould (such as a die cylinder) that rolls along in a clockwise direction to form a plurality of discrete abrasive blocks. The mould has a gravure pattern corresponding to the geometric shape of the abrasive blocks. In an embodiment, the gravure pattern may be any geometric shapes including a regular shape, such as hexagonal shape, circular shape, square shape, regular triangular shape. After the foregoing steps, the fixed abrasive pad provided by the embodiment of the invention is formed, which is shown in FIG. 7.

In conclusion, the fixed abrasive pad and the method for forming the same provided by embodiments of the present invention have at least the following advantages and benefits.

The fixed abrasive pad includes a plurality of discrete abrasive blocks attached to a substrate. Each discrete includes a plurality of abrasive sub-layers having a same or similar thickness. The abrasive density in the abrasive sub-layers increases layer-by-layer from the top sub-layer to the bottom sub-layer according to a predetermined ratio. Therefore, the decreasing level of the surface area of the abrasive block is related to the increasing level of the density of the abrasive, and provides a stable the polishing process.

Further, the lower abrasive sub-layers have a relatively higher density of the abrasive, which is beneficial to a high polishing efficiency. Therefore, the utilization ratio and the operating lifetime of the fixed abrasive pad may be improved.

The invention is disclosed, but not limited, by preferred embodiment as above. Based on the disclosure of the invention, those skilled in the art can make any variation and modification without departing from the scope of the invention. Therefore, any simple modification, variation and polishing based on the embodiments described herein is within the scope of the present invention.

What is claimed is:

1. A fixed abrasive pad, comprising:

a substrate; and a plurality of discrete abrasive blocks attached on the substrate, wherein each of the abrasive blocks comprises a plurality of abrasive sub-layers including at least a top abrasive sub-layer, a second abrasive sub-layer, and a bottom abrasive sub-layer, and wherein an abrasive density of each of the plurality of abrasive sub-layers increases layer-by-layer from the top abrasive sub-layer to the bottom abrasive sub-layer by a predetermined ratio between 1.099 and 1.124 which is defined as the ratio of a measured abrasive block surface area of a topmost surface of a sub-layer to a measured abrasive block surface area of a bottommost surface of the same sub-layer; and wherein, provided that x represents an abrasive density of the top abrasive sub-layer, y represents the predetermined ratio, n (n>2) represents a number of an abrasive sub-layer counting from the top abrasive sub-layer, the abrasive density of each abrasive sub-layer from the second abrasive sub-layer to the bottom abrasive sub-layer is defined by $x*y^{(n-1)}$.

2. The fixed abrasive pad according to claim 1, wherein the abrasive sub-layers have substantially a same thickness and the thickness of each abrasive sub-layer is controlled by adjusting a pressure applied to a covering plane immediately above each abrasive sub-layer after a deposition of each abrasive sub-layer.

3. The fixed abrasive pad according to claim 2, wherein the thickness is about 5 microns.

4. The fixed abrasive pad according to claim 1, wherein the predetermined ratio is a ratio of a surface area of a specific abrasive sub-layer of an abrasive block before the specific abrasive sub-layer is polished away against a wafer to a surface area of an abrasive sub-layer immediately after the specific abrasive sub-layer of the abrasive block after the specific abrasive sub-layer is polished away.

5. The fixed abrasive pad according to claim 1, wherein each abrasive block comprises a number of abrasive sub layers ranging from 3 to 10.

6. The fixed abrasive pad according to claim 1, wherein the discrete abrasive blocks comprise a hexagon-shaped structure.

7. The fixed abrasive pad according to claim 6, wherein the hexagon-shaped structure comprises a height of about 30 microns and a width of about 108 microns.

8. A method for forming a fixed abrasive pad, comprising:

providing a substrate;

successively depositing a plurality of abrasive sub-layers on the substrate; and patterning the abrasive sub-layers to form a plurality of discrete abrasive blocks, wherein the depositing of each abrasive sub-layer is followed by a solidifying step, wherein an abrasive density of each of the plurality of abrasive sub-layers increases layer-by-layer from a top abrasive sub-layer, a second abrasive sub-layer, to a bottom abrasive sub-layer by a predetermined ratio between 1.099 and 1.124 which is defined as the ratio of a measured abrasive block surface area of a topmost surface of a sub-layer to a measured abrasive block surface area of a bottommost surface of the same sub-layer wherein the patterning is achieved using a mould having a gravure pattern corresponding to a geometric shape of the discrete abrasive blocks; and wherein, provided that x represents an abrasive density of the top abrasive sub-layer, y represents the predetermined ratio, n (n>2) represents a number of an abrasive sub-layer counting from the top abrasive sub-layer, the abrasive density of each abrasive sub-layer from the second abrasive sub-layer to the bottom abrasive sub-layer is defined by $x*y^{(n-1)}$.

9. The method according to claim 8, wherein the abrasive sub-layers have substantially a same thickness and the thickness of each abrasive sub-layer is controlled by adjusting a pressure applied to a covering plane immediately above each abrasive sub-layer after a deposition of each abrasive sub-layer.

10. The method according to claim 8, wherein the predetermined ratio is a ratio of a surface area of a specific abrasive sub-layer of an abrasive block before the specific abrasive sub-layer is polished away against a wafer to a surface area of an abrasive sub-layer immediately after the specific abrasive sub-layer of the abrasive block after the specific abrasive sub-layer is polished away.

11. The method according to claim 8, wherein each of the discrete abrasive blocks comprises a number of abrasive sub layers ranging from 3 to 10.

12. The method according to claim 8, wherein the solidifying step comprises:

covering each deposited abrasive sub-layer with a cover; and cooling the cover by injecting deionized water at a temperature ranging from 30° C. to 50° C.

13. The method according to claim 12 further comprising adjusting a pressure on the cover to obtain a thickness of the abrasive sub-layer.

14. The method according to claim 13, wherein the thick ness is about 5 microns.

15. The method according to claim 8, wherein the discrete abrasive blocks comprise a hexagon-shaped structure.

16. The method according to claim 15, wherein the hexagon-shaped structure comprises a height of about 30 microns and a width of about 108 microns.

* * * * *